United States Patent [19]

Johnson

[11] 4,167,176

[45] Sep. 11, 1979

[54] COMBINATION STOVE AND FIREPLACE

[76] Inventor: Paul E. Johnson, 4123 Jasper Rd., Springfield, Oreg. 97477

[21] Appl. No.: 859,156

[22] Filed: Dec. 9, 1977

[51] Int. Cl.[2] ..... F24B 1/18; F24B 1/26

[52] U.S. Cl. ..... 126/120; 126/142; 126/299 R

[58] Field of Search ..... 126/120, 123, 126, 142, 126/143, 137, 301, 302, 303, 307 R, 4, 25 R, 299 R, 314, 315, 317; 98/58, 60; 183/3

[56] References Cited

U.S. PATENT DOCUMENTS

| | | | |
|---|---|---|---|
| 440,475 | 11/1890 | Hall | 126/317 |
| 3,445,291 | 7/1969 | Glass | 126/25 R |
| 3,994,274 | 11/1976 | Manno | 126/120 |
| 4,082,322 | 4/1978 | Lever | 126/121 |

*Primary Examiner*—Carroll B. Dority, Jr.
*Assistant Examiner*—Lee E. Barrett
*Attorney, Agent, or Firm*—Kolisch, Hartwell, Dickinson & Stuart

[57] ABSTRACT

A combination stove-fireplace assembly for an open-top fire pit. A fire hood supported on legs above the pit is vertically movable between raised and lowered positions through a cable and pulley arrangement located below the top of the pit. The hood is vented by a unitary stack which moves vertically through a roof mount as the hood is raised and lowered.

4 Claims, 3 Drawing Figures

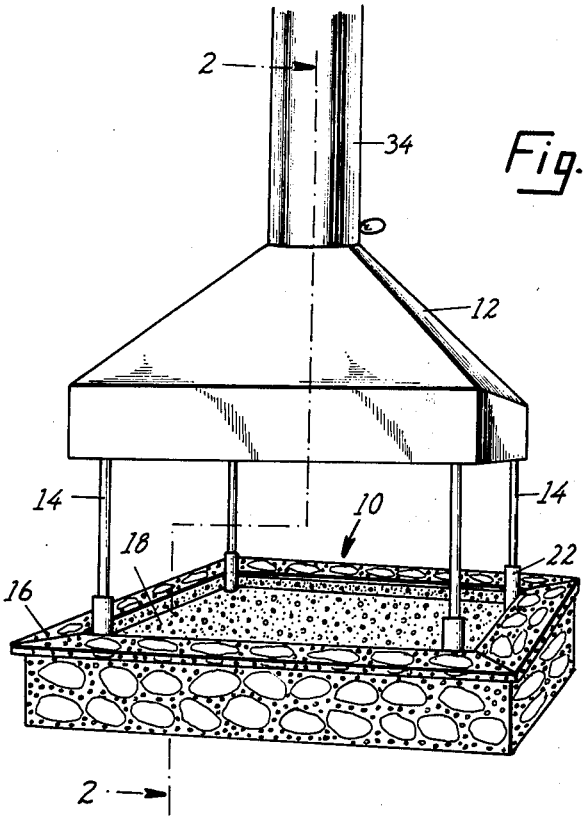
Fig. 1
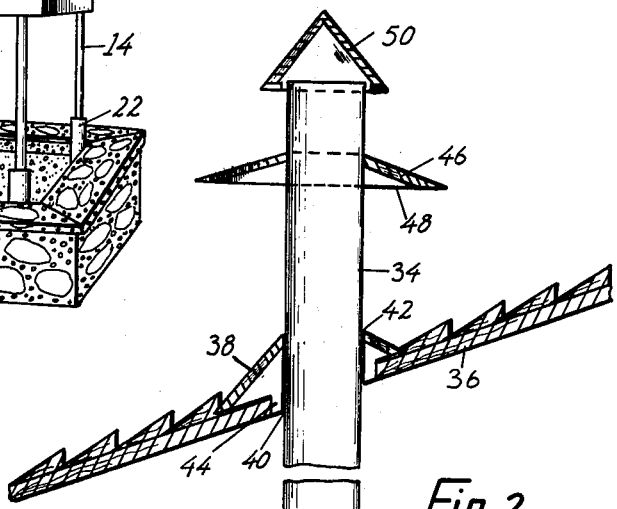
Fig. 2
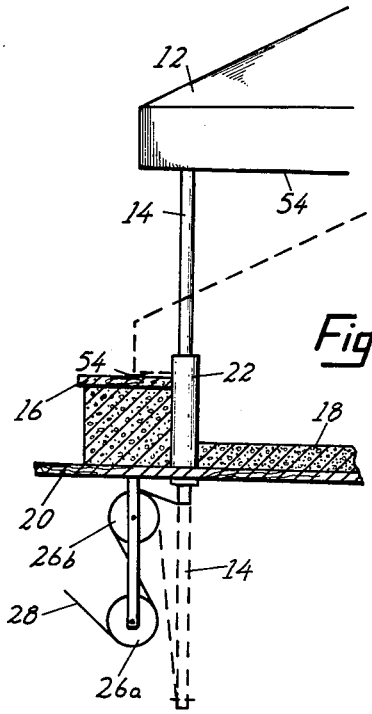
Fig. 3
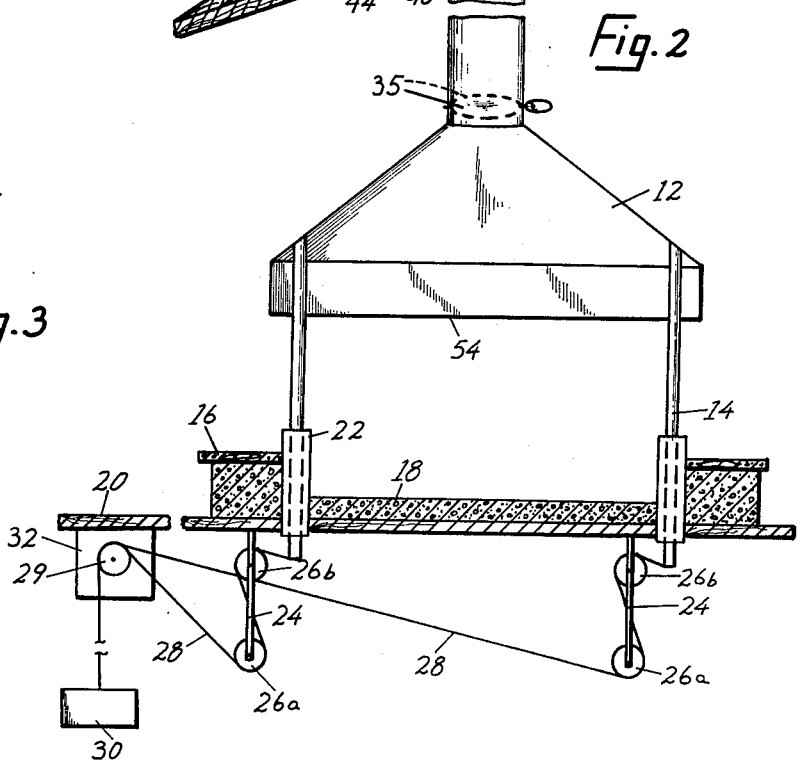

COMBINATION STOVE AND FIREPLACE

BACKGROUND AND SUMMARY OF THE INVENTION

The present invention relates to fireplaces in general, and in particular to a combination stove-fireplace assembly.

In the past, a number of vertically movable fire hoods designed for use with wood burning stoves have been proposed. Such movable hoods can be adjustably lowered over the tops of stoves during cooking to carry off steam odors and smoke through a stack connected to the hood.

More recently a vertically movable fire hood in combination with an open-pit fireplace has been proposed in U.S. Pat. No. 3,994,274 to Manno. This movable hood allows the fire pit to be used as an open-pit fireplace when the hood is in a raised position, or as an oven or for charcoaling when the hood is positioned adjacent the base of the fire pit.

The above-cited, movable hoods are mounted on various overhead supports, such as ceiling supports or side braces and the like. Inasmuch as fire hoods and attached stove-pipes are generally heavy, such wall or ceiling supports must of necessity be sturdy and somewhat heavy, and may even require additional wall or ceiling reinforcement.

Furthermore, the method of overhead mounting is complicated by the vertical movement of the venting stack as the fire hood is raised or lowered. In the above-cited inventions, this problem is met by venting the fire hood with a telescopic stack which can vary in length according to the vertical position of the fire hood.

In view of the above, it can be appreciated that a number of structural problems can be circumvented by mounting such shiftable fire hoods from below. Specifically, the need for heavy overhead supports and possible wall or ceiling reinforcement is eliminated; the venting stack may be a simple unitary pipe which slideably extends through an appropriate roof receptacle; and finally, since the fire hood is raised and lowered from below, the shifting means can be kept out of view and generally be more convenient to operate.

To this end the present invention provides a shiftable fire hood supported on legs above a fire pit, which hood is vertically movable between raised and lowered positions by means of a cable and pulley arrangement located below the top of the fire pit. The fire hood is vented by a unitary vertically extending stack which slides vertically through a roof mount when the fire pit is raised and lowered.

It is a general object of this invention to provide a fire hood vertically mounted above an open-top fire pit which may easily be raised and lowered to form, in combination with the fire pit, a fireplace or a stove.

It is another object of the invention to provide a vertically adjustable fire hood which is supported above an open-top fire pit by vertically positionable legs.

It is yet a further object of the invention to provide a unitary stack for venting a shiftable fire hood, which stack slides through a roof mount when the fire hood is raised and lowered.

These and other objects and features of the invention will now be described more fully with reference to the following detailed description of a preferred embodiment of the invention and the accompanying drawings.

BRIEF DESCRIPTION OF THE DRAWINGS

FIG. 1 is a perspective view of a fire hood constructed in accordance with the invention mounted above an open-top fire pit.

FIG. 2 is a foreshortened partially sectional view of the fire hood shown in combination with a stack, one section of which is taken generally along line 2—2 of FIG. 1.

FIG. 3 is an enlarged view of the pulley and cable arrangement of FIG. 2 used for shifting the fire hood vertically.

DETAILED DESCRIPTION OF THE INVENTION

Referring now to FIG. 1, there is shown an open-top fire pit 10 and a fire hood 12 supported above the fire pit by leg means comprising four legs 14. The leg means are operatively associated with shifting means located below the fire pit for positioning the fire hood between a raised position, shown in FIG. 1 and in solid lines in FIG. 3, and a lowered position (shown in dashed lines in FIG. 3) in which the hood encloses the open top of the fireplace.

Fire pit 10 is a conventional open-pit fire pit having a peripheral ledge portion 16 and a central recessed pit region 18 as shown in FIG. 2. The fire pit is constructed within a room on floor 20 in a conventional manner. Four guide sleeves 22, which are rigidly mounted at the four interior corners of the pit and which extend through floor 20, serve to guide legs 14 vertically as the hood position is shifted.

As shown in FIGS. 2 and 3, the shifting means for raising and lowering the fire hood includes pulley means mounted adjacent the legs and cable means trained over the pulley means and operatively attached to the legs. The pulley means includes vertically mounted pulley supports 24, each support being mounted adjacent a leg 14 and supporting for rotation thereon lower pulley **26*a* and upper pulley 26*b*. The cable means includes cables 28, each cable attached at one end to a counterweight 30 and attached at its other end to the lower end of one of legs 14. Cables 28 are entrained over a pair of motor driven pulleys 29 adjacent the attachment to counterweight 30. Counterweight 30 is a counterbalance means for counterbalancing at least a portion of the combined weight of fire hood 12 and stack 34**.

Pulleys 29 are driven by an electric motor 32, there being one motor for the pair of adjacent legs shown in FIG. 2 and a second motor for the other pair of adjacent legs. The two motors are synchronously activated by an electric switch placed conveniently near the fire pit. The motors can be activated to turn pulleys 29 either clockwise or counterclockwise to either lower or raise the fire hood. When not activated, the motors are stationary, and together with counterbalance 30, hold the fire hood at the selected position.

The fire hood is vented by means of a unitary vertically extending stack 34 communicating with the upwardly angled portions of the fire hood. Stack 34 extends from the fire hood to a point above the roof 36 of the building housing the fire pit. The stack is provided with a conventional damper 35 for controlling the flow of gases and smoke through the fire hood.

Stack 34 extends slidably through a roof mount 38 mounted in roof 36 by conventional means. The roof mount is a conical metal shield having a central opening 40 for receiving the stack slidably therethrough, the diameter of opening 40 being sufficient to provide a gap 42 between the outer surface of the stack and the opening 40. Roof mount 38 additionally provides a heat insulation space 44 between the roof and opening 40.

Attached to the stack, exterior to the roof mount, is a shield 46 which extends radially outward from the stack to prevent rain and snow from reaching gap 42 between the roof mount and the stack. The shield is so positioned on the stack that its lower edge 48 overhangs the upper edge of the roof mount when the fire hood is in its lowered position. The stack is provided with a conventionally mounted top 50 for discharging vented gas and smoke.

The operation of the combination stove-fireplace will now be described with reference to FIG. 2. When it is desired to use the fire pit as an open-pit fireplace, the fire hood is raised, by operating the pulley and cable means, to a position substantially above ledge portion 16 of the fireplace. In this position, gases and smoke issuing from a fire in the firepit are vented to the fire hood, with gas flow controlled in part by damper 35 and carried out of the building through stack 34.

Once a smoldering fire is attained in the fire pit, and it is desired to use the pit as a stove or "charcoaler", the hood is lowered by operating the cable and pulley means until the lower edge 54 of the hood rests firmly against ledge portion 16 as shown in FIG. 3. As the hood is moved downwardly, counterweights 30 are drawn upwardly by the cables. At the same time, stack 34 slides downwardly through opening 40 in the roof mount. The fire hood would normally also be lowered when the fire pit is not in use, thus to prevent unwanted drafts from entering the room through the stack.

It is apparent that modifications of the present invention are possible, and while the invention has been described in a particular preferred embodiment, the invention is not to be limited to the disclosure of the details shown but accorded the full scope of the following claims.

It is claimed and desired to secure by Letters Patent:

1. Apparatus for selectively converting an open-top fire pit into a stove comprising, a fire hood, leg means for supporting said fire hood, and shifting means disposed adjacent and operatively connected to said leg means, selectively operable for raising and lowering said hood between a raised position in which the hood is spaced from the pit, and a lowered position in which the hood encloses the open top of the pit.

2. The apparatus of claim 1, wherein said shifting means is located below the open top of the fire pit.

3. The apparatus of claim 1, wherein said shifting means includes pulley means mounted adjacent said leg means, and cable means trained over said pulley means and operatively attached to said leg means.

4. The apparatus of claim 3 further comprising a counterbalance means operatively associated with said cable means for counterbalancing at least a portion of the weight supported by said leg means.

* * * * *